United States Patent [19]

Hibberd

[11] Patent Number: 4,708,152

[45] Date of Patent: Nov. 24, 1987

[54] PAINT ROLLER CLEANER APPARATUS

[76] Inventor: Carl G. Hibberd, 1613 S. Cincinnati, Tulsa, Okla. 74119

[21] Appl. No.: 900,491

[22] Filed: Aug. 26, 1986

[51] Int. Cl.[4] ..... B08B 3/02

[52] U.S. Cl. ..... 134/138; 134/149; 134/153

[58] Field of Search ..... 68/213; 134/138, 139, 134/149, 153

[56] References Cited

U.S. PATENT DOCUMENTS

| | | | |
|---|---|---|---|
| 2,542,491 | 2/1951 | Engel | 68/213 X |
| 2,831,488 | 4/1958 | Anderson | 68/213 X |
| 3,073,325 | 1/1963 | Rebizzo et al. | 134/153 X |
| 3,428,060 | 2/1969 | Spivey | 134/138 X |
| 3,472,251 | 10/1969 | Parker, Jr. | 134/138 |
| 3,577,280 | 5/1971 | George | 134/138 |
| 3,688,785 | 9/1972 | Stevens et al. | 134/138 |
| 3,731,697 | 5/1973 | Yost | 134/138 |
| 3,755,840 | 9/1973 | Barger | 134/138 X |
| 3,886,960 | 6/1975 | Krueger | 134/138 |
| 4,061,153 | 12/1977 | Doherty | 134/138 |

FOREIGN PATENT DOCUMENTS

| | | | |
|---|---|---|---|
| 2138659 | 2/1973 | Fed. Rep. of Germany | 134/138 |

*Primary Examiner*—Philip R. Coe

*Attorney, Agent, or Firm*—Head & Johnson

[57] ABSTRACT

This is a cleaning device for removing water soluble paint from a paint roller. The roller to be cleaned is shoved over a roller holder which is rotatably mounted in a vertical position in a container such as an open top bucket. A plurality of fan type jets are supported from an inlet water manifold. These fan jets are adjusted in position to direct a thin wall of water essentially tangentially against the paint roller to cause the roller to rotate and to contact every point on the roller.

4 Claims, 5 Drawing Figures

PAINT ROLLER CLEANER APPARATUS

BACKGROUND OF THE INVENTION

1. Field of the Invention

This invention relates to improvements in painting equipment and more particularly to a paint roller cleaning apparatus.

2. Description of the Prior Art

It is common practice in the painting industry to clean and reuse paint rollers in order to reduce the overall cost of the painting equipment. The thorough cleaning of the usual paint roller presents certain problems. If the cleaning is not complete, any paint which remains after cleaning may contaminate the paint being used in the next succeeding painting operations and/or it may make the use of the paint roller less efficient. Many devices have been developed to clean paint rollers. Examples of these devices are shown in the Spivey U.S. Pat. No. 3,428,060, issued Feb. 18, 1969, and entitled "Apparatus for Cleaning Paint Rollers;" Parker, Jr., U.S. Pat. No. 3,472,251 issued Oct. 14, 1969 and entitled "Centrifugal Water-Action Roller Cleaner"; George U.S. Pat. No. 3,577,280, issued May 4, 1979, and entitled "Faucet Mounted Cleaning Device for Paint Rollers;" Stevens et al U.S. Pat. No. 3,688,785, issued Sept. 5, 1972, and entitled "Paint Roller Cleaner;" Yost U.S. Pat. No. 3,731,697, issued May 8, 1973, and entitled "Paint Roller Cleaning Apparatus;" Barger U.S. Pat. No. 3,755,840, issued Sept. 4, 1973, and entitled "Cleaning, Spin Drying and Fluffing Paint Roller Device;" Krueger U.S. Pat. No. 3,886,960, issued June 3, 1975, and entitled "Paint Roller Cleaning Apparatus;" the Daugherty U.S. Pat. No. 4,061,153, issued Dec. 6, 1977, and entitled "Paint Roller Cleaning Apparatus" and the German Pat. No. 2,138,659, issued in 1973.

The patent to Yost U.S. Pat. No. 3,731,697, includes a nozzle carried by hood to receive cleaning fluid under pressure with a nozzle having an orifice outlet formed to produce a fan shaped spray of fluid directed at the cleaning zone that receives the roller. In this apparatus the roller stays on the handle and the paint roller is held inside the container to be contacted by the spray of water. This system has not been used to my knowledge and appears to be little more effective than holding the paint roller handle by hand and spraying water directly from a garden hose on to it. The axle of the nozzle in Yost is pointed outwardly.

To my knowledge, none of these prior art paint roller cleaners are sold by paint stores or used by painters. Some of these prior art devices direct jets or fine lines of water toward a paint roller to clean it. This form of paint cleaning apparatus has been tried by painters but none to my knowledge have continued using such cleaning apparatus. The apparent reason is that they do not clean the paint roller adequately.

SUMMARY OF THE INVENTION

The present invention is directed to a cleaning apparatus for cleaning paint rollers. This apparatus permits the complete cleaning of paint rollers in that means are provided to assure contact of every area of the paint roller. I use an open top container having a closed bottom and one which is capable of holding water. An elongated upright manifold is attached to the side of the container. An elongated upright paint roller holder is mounted substantially to the elongated manifold by a support rod supported at and by the lower end of the manifold above the bottom of the container. I provide a plurality, e.g. three fan jets with the slot in each fan jet aligned with the others. Each fan jet is capable of spraying out a cleaning fluid such as water in a fan or thin wall shape. With these fan jets arranged properly, they are directed essentially tangentially against the edge of the paint roller to be cleaned and causes the roller to spin. The wall of water contacts a complete line of the surface of the paint roller with no omissions therebetween. As a roller rotates the line of the fan water contacts the entire surface of the paint roller. This obtains complete cleaning of the paint roller, a result not heretofore attained.

Means are provided to connect a garden hose directly to the vertical manifold. There need be no drain holes in the container and when the paint roller is cleaned, the waste water in the container can then be disposed of in any acceptable manner.

DETAILED DESCRIPTION OF THE PREFERRED EMBODIMENT

Figure 1:
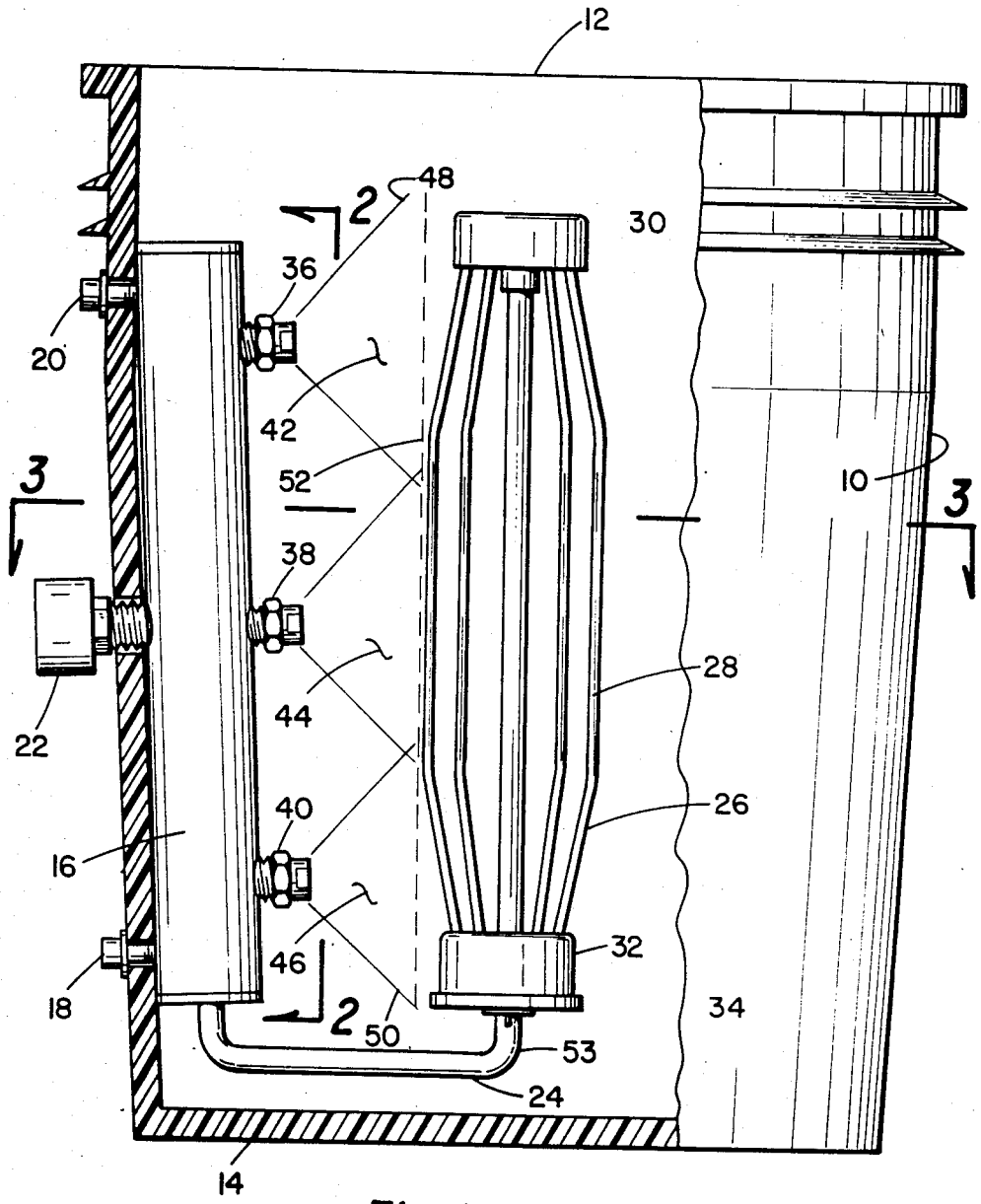
FIG. 1 is a view with the container partially cut away to show the paint roller holder supported by the water manifold.

Attention is first directed to FIG. 1 which shows a container 10 with a portion of its walls cut away to show water inlet manifold 16 and paint roller holder 26 supported from the manifold by support rod 24. Container 10 has an open top 12 and a closed bottom 14. The water manifold 16 is secured to the wall of container 10 by bolts and nuts 18 and 20. An inlet connection 22 is provided so that the interior of the manifold 16 can be connected directly to a water supply such as a common garden hose for example.

A plurality of fan jets are provided in the wall of manifold 16. In this illustration three are shown fan jets 36, 38 and 40. Each one of these has a fan type spray 42, 44 and 46. This in essence makes a wall of water and results in a line of water from point 48 at the top of fan 42 to point 50 at the lower end of wall of water 46. This is indicated by the dashed line 52.

The paint roller holder 26 shown in FIG. 1 includes bow springs 50 which have upper cap 30 and lower cap 32. There are bearings 34 provided at the bottom of the holder to support the paint roller holder 26 from shaft 54 which extends upwardly from horizontal rod 24 which is connected to and supported from the lower end of the manifold 16. This unitary arrangement of the manifold and paint roller holder is especially easy to assemble with a bucket as only three holes are required to be drilled in the side of an ordinary bucket and proper alignment is assured by the prefabrication of the unit of the manifold and paint roller holder. Paint roller holder 26 is free to rotate with respect to the upright portion or shaft 54 of rod 24.

Figure 2:
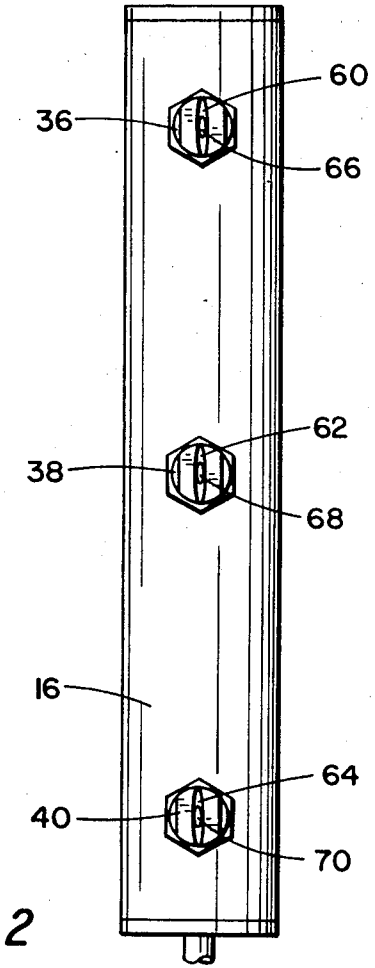
FIG. 2 is a view taken along the line 2—2 of FIG. 1.

Attention is next directed to FIG. 2 which illustrates a full face view of the fan jets 36, 38 and 40. As shown therein, fan jets 36, 38 and 40 have a vertical slot 60, 62 and 64 respectively. Each vertical slot 60, 62 and 64 has an inlet orifice 66, 68 and 70.

Figure 3:
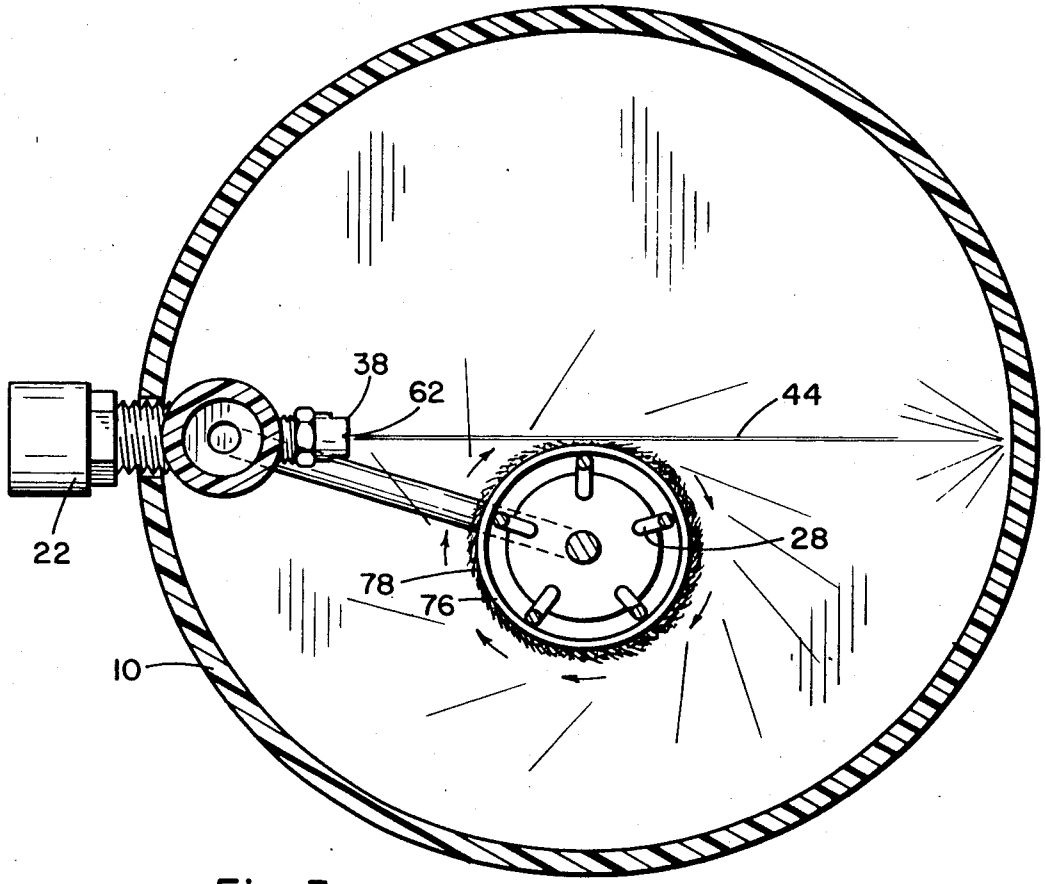
FIG. 3 is a view taken along the line 3—3 of FIG. 1.
Figure 4:
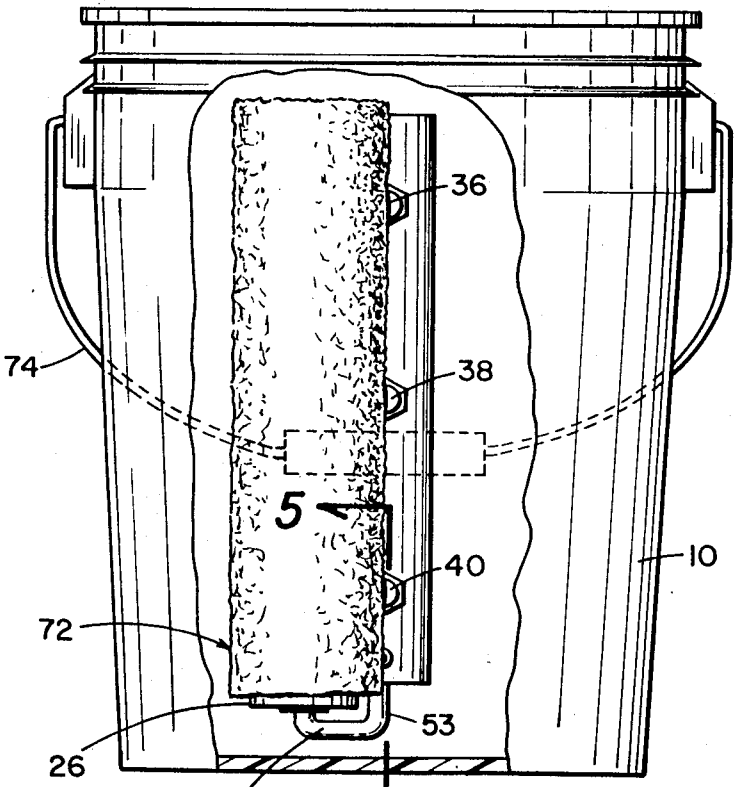
FIG. 4 shows a partially cut away view of the container showing the paint roller in position to be cleaned.

Attention is next directed to FIG. 4 which shows a paint roller 72 mounted over the paint roller holder 26 in container 10 having handle 74. As is well known, paint rollers 72 are essentially thin wall hollow cylinders with the paint holding material on the outer wall thereof. As shown in FIG. 4, the fan jets 36, 38 and 40 are aligned so that their vertical slots direct a wall of water essentially tangential to the paint roller to be cleaned. The fan shaped jet is the same plane as directed in the axis of the paint roller holder. The fan jets are positioned so that they are essentially tangential to the core 76 and as shown in FIG. 3, is directed essentially tangential to the core 76 of the paint roller and will contact all of the paint holding layer 78. As water is directed through the fan jets, the paint roller will rotate and all of its paint holding material 78 will be directly and completely impinged by the wall of water depicted in FIG. 1 as a line 52 of the fan jets. Thus, as the paint roller rotates the wall of water will contact every bit or area thereof and will rapidly clean it in a matter of not over a minute or so.

Figure 5:
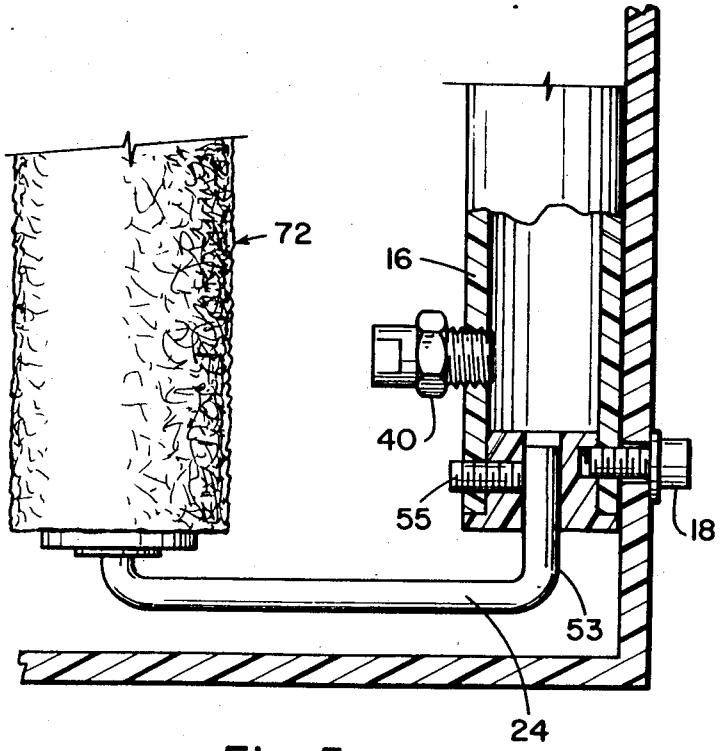
FIG. 5 is a view taken along the line 5—5 of FIG. 4.

As shown in FIG. 5, shaft 53 is held in a fixed position with respect to manifold 16 by set screw 55. Before I tighten such screw 55 I make sure that the fan jet as indicated in FIG. 3, will strike the nap on the paint roller at the proper position. I then tighten such screw 55. For various type painting jobs different tickeness nap are provided. If I have been cleaning paint rollers having a short or narrow nap, and then I start using a paint roller that has a long or thicker nap, it is necessary to rotate the shaft 53 so that the fan jets of water will strike the nap at the proper positioning. After loosening set screw 55 I can thus adjust the relative position of the fan jet by rotations of shaft 53 in the base of container 16 so that it strikes the outside edge of the nap so that I increase the rpm's of the paint roller and this increases the efficiency. I then tighten the set screw 55. Increasing the rpm's increases the centrigual force and thus increases the efficiency.

FIG. 5 is a view taken along the line 5—5 of FIG. 4 and shows manifold 16, lower fan jet 40 and paint roller 72. Upright section 53 is held to the manifold by set screw 55.

I have recently built a paint roller cleaner substantially as described herein. I have demonstrated this to some paint stores and painters. The result has been that one major paint store chain has placed an order for a substantial number of these paint roller cleaners. The professional painters which I have demonstrated this to have without exception given it a very high mark and said this is the type paint cleaner that they have been wanting and that it fully and completely satisfies their needs which has not heretofore been the case.

While the invention has been described with a certain degree of particularity, it is manifest that many changes may be made in the details of construction and the arrangement of components without departing from the sprit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A cleaning apparatus for a paint roller which comprises:

an open top container having a closed bottom and capable of holding a liquid;

an elongated paint roller holder for supporting a paint roller within said container;

a water manifold attached to the wall of said container;

a plurality of jet fan nozzles attached to said manifold, each said jet fan nozzle having a notch therein and the notches being substantially aligned, each said notch being of a character to have an output fan type discharge directed essentially tangentially toward said paint roller periphery when mounted on said paint roller holder;

support rod supporting said elongated paint roller holder only from said manifold above the bottom of said container, said rod being rotatable with respect to said manifold to adjust the position of the jet fan nozzles with respect to said paint roller holder.

2. A cleaning apparatus as defined in claim 1 including a hose connecting means extending through the wall of said container so as to be capable of conveying water therethrough to said manifold.

3. A cleaning apparatus as defined in claim 1 in which the wall and bottom of said container are free from drainage holes.

4. A cleaning apparatus for a paint roller which comprises:

an open top container having a closed bottom and capable of holding water;

an elongated paint roller holder for supporting the paint roller within said container;

a tubular manifold having a longitudinal axis;

means to attach said tubular manifold to the wall of said container;

a paint roller holder support rod having a straight section intermediate its ends and having two end members at approximately right angles to the straight section, a first end member of said rod rotatably supported from the lower end of said manifold and the other end rotatably supporting said elongated paint roller holder above the bottom of said container;

a set screw to hold said first end member of said rod in selected rotational position;

a plurality of jet fan nozzles each having a slot therein and the slots being aligned, said nozzles each being perpendicular to the longitudinal axis of said manifold;

said nozzles being directed to divert a thin wall of water directed tangentially toward the periphery of the paint roller when mounted upon said paint roller holder.

* * * * *